US010653576B1

(12) United States Patent
Song

(10) Patent No.: US 10,653,576 B1
(45) Date of Patent: May 19, 2020

(54) APPARATUS FOR ASSISTING TOILET USER IN STANDING UP

(71) Applicant: Soon Young Song, Anyang-si (KR)

(72) Inventor: Soon Young Song, Anyang-si (KR)

( * ) Notice: Subject to any disclaimer, the term of this patent is extended or adjusted under 35 U.S.C. 154(b) by 0 days.

(21) Appl. No.: 16/282,320

(22) Filed: Feb. 22, 2019

(30) Foreign Application Priority Data

Dec. 4, 2018 (KR) ..... 10-2018-0154203

(51) Int. Cl.
*A61G 7/10* (2006.01)
*A47K 13/10* (2006.01)

(52) U.S. Cl.
CPC ..... *A61G 7/1007* (2013.01); *A47K 13/105* (2013.01); *A61G 7/1094* (2013.01)

(58) Field of Classification Search
CPC ..... A47K 13/10; A47K 13/105; A61G 5/14; A61G 7/1007
USPC ..... 297/330
See application file for complete search history.

(56) References Cited

U.S. PATENT DOCUMENTS 5,303,982 A * 4/1994 Johnston ..... A61G 5/14 297/338
2010/0219668 A1* 9/2010 Nelson ..... A61G 5/14 297/330
2013/0175840 A1* 7/2013 Nadav ..... A61G 5/14 297/313
2013/0232686 A1* 9/2013 Schwartz ..... A61G 5/14 4/667

FOREIGN PATENT DOCUMENTS

JP 2018153371 * 10/2018 ..... A47K 17/02
KR 20-0232669 Y1 10/2001

* cited by examiner

*Primary Examiner* — David P Angwin
*Assistant Examiner* — Nicholas A Ros
(74) *Attorney, Agent, or Firm* — Revolution IP, PLLC

(57) ABSTRACT

An apparatus for aiding a user of a toilet in standing up, includes a movable seat movably mounted to the toilet; and a seat actuator arranged adjacent to the toilet and actuating the movable seat to move having at least one of lifting movement and pivoting movement, the seat actuator including: a base frame adjacent to and stationarily mounted to the toilet; a driver mounted to the base frame; a driving frame driven to reciprocate by the driver; and a link assembly including a first side connected to the driving frame and a second side connected to a connection link coupled to the movable seat and producing lifting movement and pivoting movement of the movable seat in accordance with reciprocation of the driving frame.

2 Claims, 9 Drawing Sheets

APPARATUS FOR ASSISTING TOILET USER IN STANDING UP

CROSS-REFERENCE TO RELATED APPLICATION

This application claims priority from Korean Patent Application No. 10-2018-0154203, filed on Dec. 4, 2018 in the Korean Intellectual Property Office, the disclosure of which is incorporated herein by reference.

BACKGROUND OF THE INVENTION

(a) Field of the Invention

The disclosure relates to an apparatus for aiding a toilet user in standing up, and more particularly to an apparatus having a simple structure for aiding a toilet user in standing up, in which a movable seat where the toilet user sits is automatically movable having at least one of lifting movement and pivoting movement, thereby simplifying the structure and assisting the toilet user in easily and safely standing up.

(b) Description of the Related Art

In general, a toilet includes a main body installed on a floor and having a moderate height so that a user can sit to relieve himself/herself, and a seat provided on the top of the main body and hinged at the back to be lifted up as necessary.

Such a toilet is comfortable to sit down and relieve nature, but makes various sick people, elderly or weak people, and disabled people, whose legs are weak, feel much difficulty in standing up from a seating position after easing nature.

To make up for such shortcomings, an sub sidebar has been conventionally installed around a toilet so that the sick people, elderly or weak people, and disabled people can sit down or stand up grabbing the side bar. However, most of them whose legs are weak are also weak in arms and therefore have a problem of difficulty in leaning on the side bar.

To solve this problem, Korean Utility Model No. 20-0232669 (hereinafter, referred to as the "related art") has proposed a toilet seat for the elderly, the weak and the lower-body disabled so that the disabled, the elderly, the weak and the like lower-body handicapped people can easily stand up from a sitting position without effort after relieving nature.

The toilet seat of the related art has an advantage of assisting the elderly, the weak and the like people in standing up easily, but is useless for the elderly, the weak and the disabled who cannot operate it with their own strength because the toilet seat employs a structure of being operated by the strength of the elderly, the weak and the like people. Also, the toilet seat of the related art has a disadvantage of resulting in considerably high possibility of unexpected severe accidents while the elderly, the weak and the disabled operate it with their own strength.

Further, to assist the elderly, the weak and the like people in easily and safely standing up, not only lifting movement for vertically moving the seat up and down but also pivoting movement to be used in combination with the lifting movement is required. However, such combination of the lifting movement and the pivoting movement makes a structure complicated and big. Accordingly, there is a need of a standing aid having a simple and small structure.

SUMMARY OF THE INVENTION

Accordingly, the disclosure is conceived to solve the foregoing problems, and an aspect of the disclosure is to provide an apparatus having a simple structure for aiding a toilet user in standing up, in which a movable seat where the toilet user sits is automatically movable having at least one of lifting movement and pivoting movement, thereby simplifying the structure and assisting the toilet user in easily and safely standing up.

In accordance with an embodiment of the present disclosure, there is provided an apparatus for aiding a user of a toilet in standing up, which has a structure where the user can sit, and includes a movable seat movably mounted to the toilet; and a seat actuator arranged adjacent to the toilet and actuating the movable seat to move having at least one of lifting movement and pivoting movement, the seat actuator comprising: a base frame adjacent to and stationarily mounted to the toilet; a driver mounted to the base frame; a driving frame driven to reciprocate by the driver; and a link assembly comprising a first side connected to the driving frame and a second side connected to a connection link coupled to the movable seat and producing lifting movement and pivoting movement of the movable seat in accordance with reciprocation of the driving frame, the link assembly comprising: a vertical movement link that comprises a first side connected to move being guided along a main operating route guide hole and a second side pivotably connected to the connection link and produces the lifting movement of the movable seat in accordance with the reciprocation of the driving frame; and a pivoting movement link that comprises a first side pivotably connected to the driving frame and a second side pivotably connected to the connection link and produces the pivoting movement of the movable seat in accordance with the reciprocation of the driving frame, the driving frame comprising: a main operating route guide hole; a sub operating route guide hole having the same shape as the main operating route guide hole and spaced apart from the main operating route guide hole equidistantly at every point, and a vertical guide hole, the first side of the vertical movement link being penetrated by a main guide pin, the main guide pin being inserted in the main operating route guide hole while penetrating the first side of the vertical movement link, and a sub guide pin being inserted in the sub operating route guide hole, and a connection guider connecting the main guide pin and the sub guide pin in a vertical direction, being inserted in the vertical guide hole, and slidable in a vertical direction.

The seat actuators may be respectively arranged at opposite sides of the toilet and form a pair.

BRIEF DESCRIPTION OF THE DRAWINGS

The above and/or other aspects of the disclosure will become apparent and more readily appreciated from the following description of the exemplary embodiments, taken in conjunction with the accompanying drawings, in which.

DETAILED DESCRIPTION

Below, embodiments of an apparatus for aiding a toilet user in standing up according to the disclosure with the foregoing objects, solutions, and effects will be described in detail with reference to the accompanying drawings.

Figure 1:
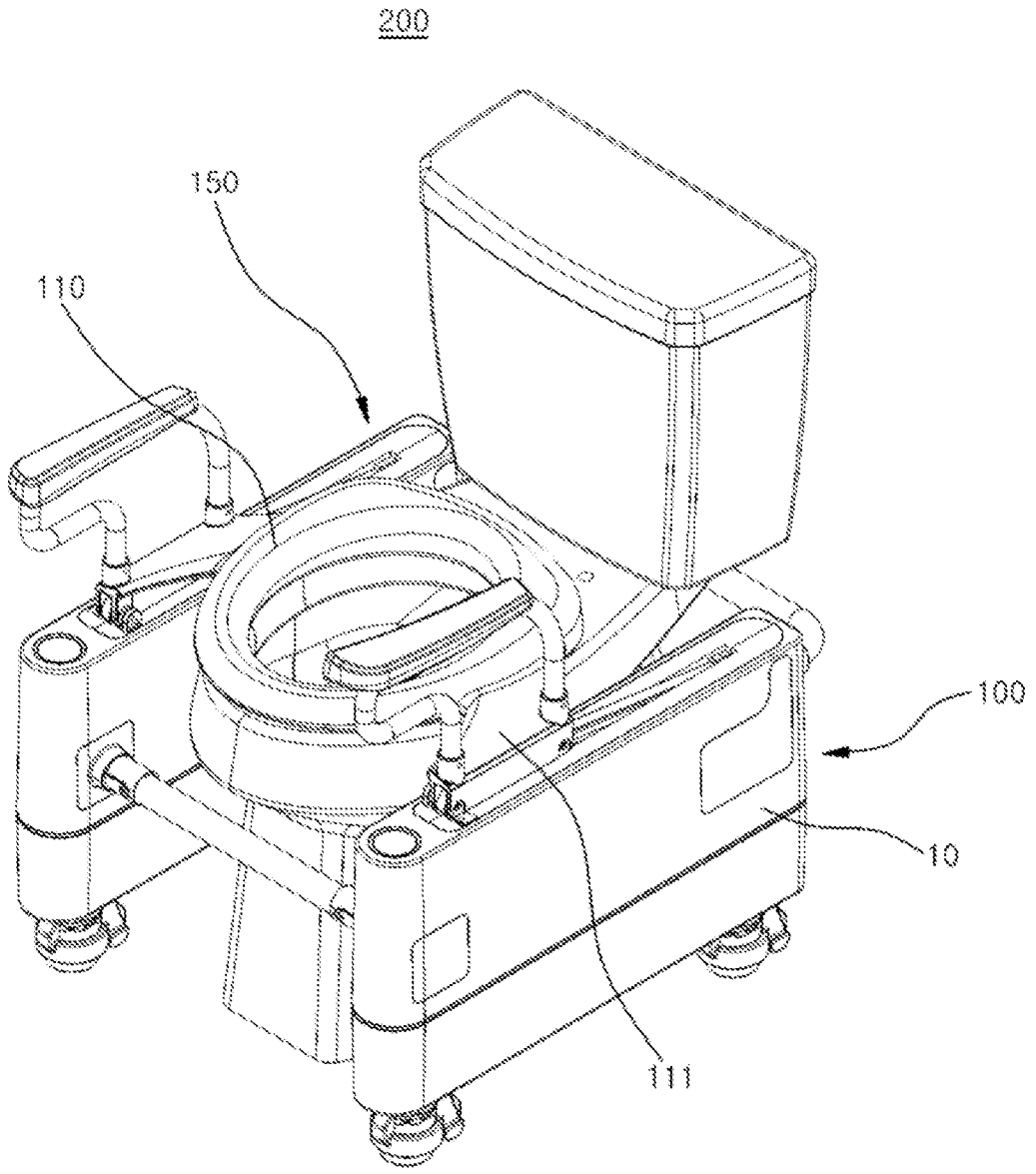
FIG. 1 is a perspective view of an apparatus for aiding a toilet user in standing up according to an embodiment of the disclosure.
Figure 2:
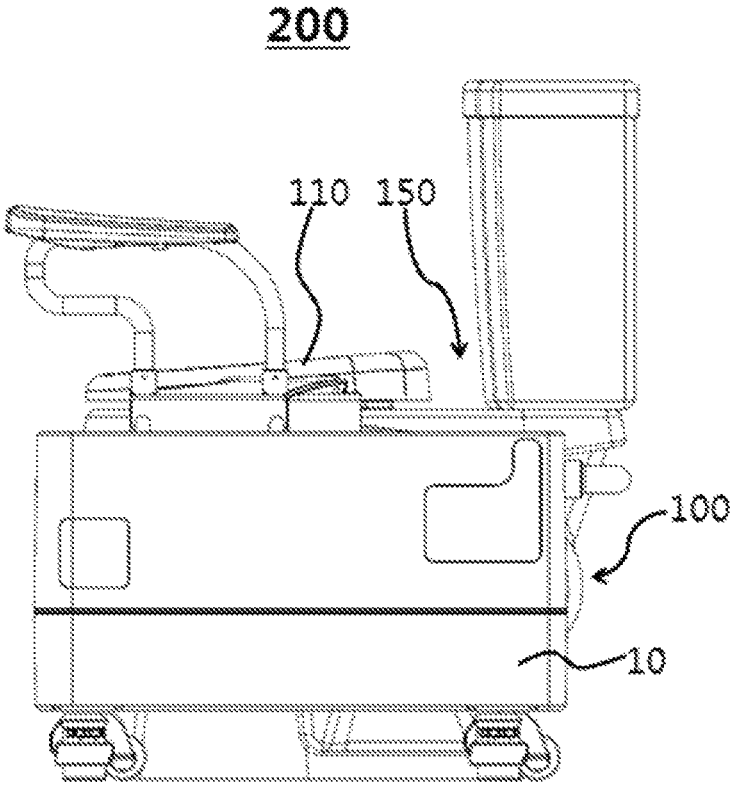
FIG. 2 is a lateral view.
Figure 3:
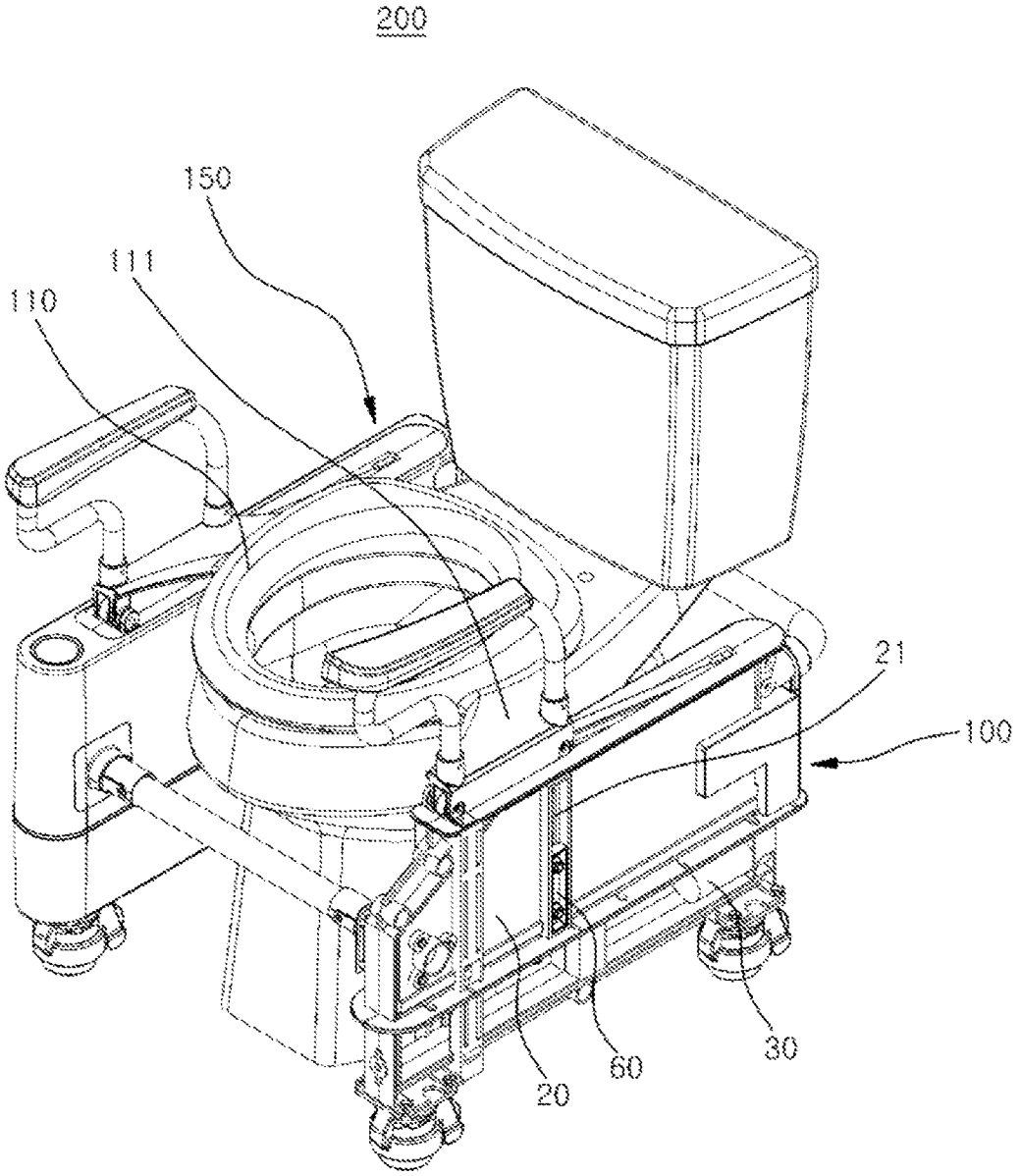
FIG. 3 is a perspective view showing that a case is separated from an apparatus for aiding a toilet user in standing up according to an embodiment of the disclosure.
Figure 4:
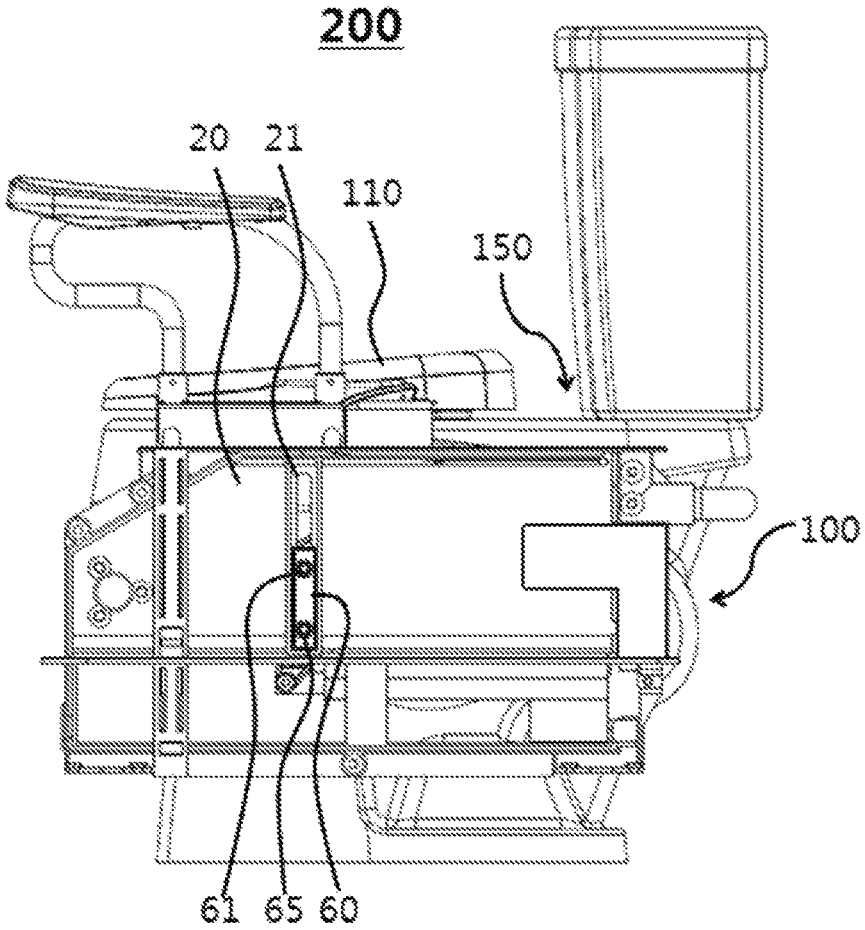
FIG. 4 is a lateral view.
Figure 5:
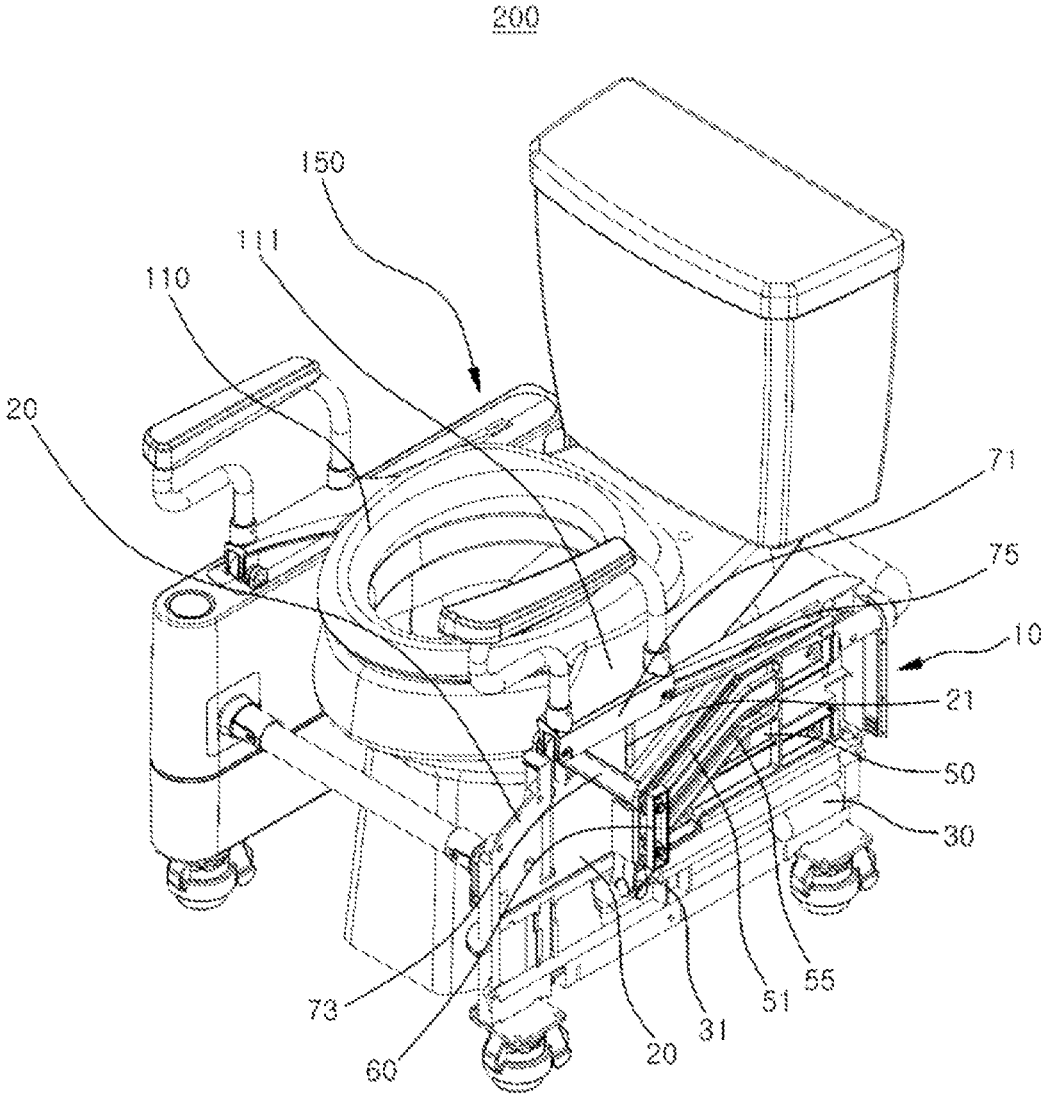
FIG. 5 is a perspective view showing that one base frame is separated from an apparatus for aiding a toilet user in standing up according to an embodiment of the disclosure.
Figure 6:
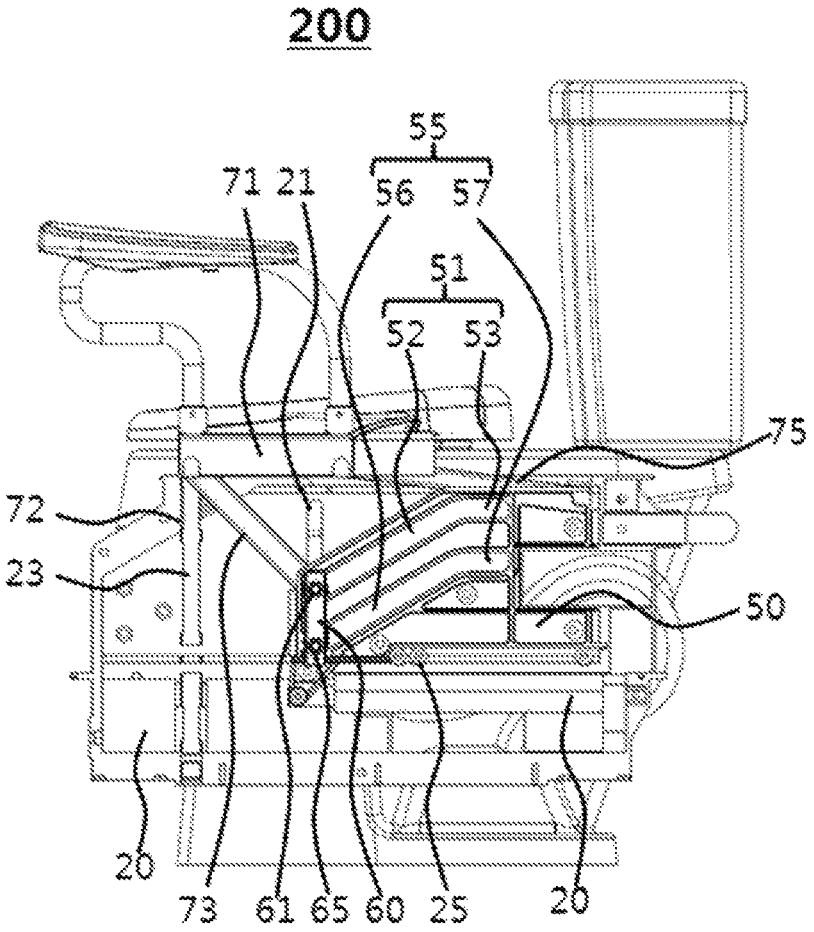
FIG. 6 is a lateral view.
Figure 7:
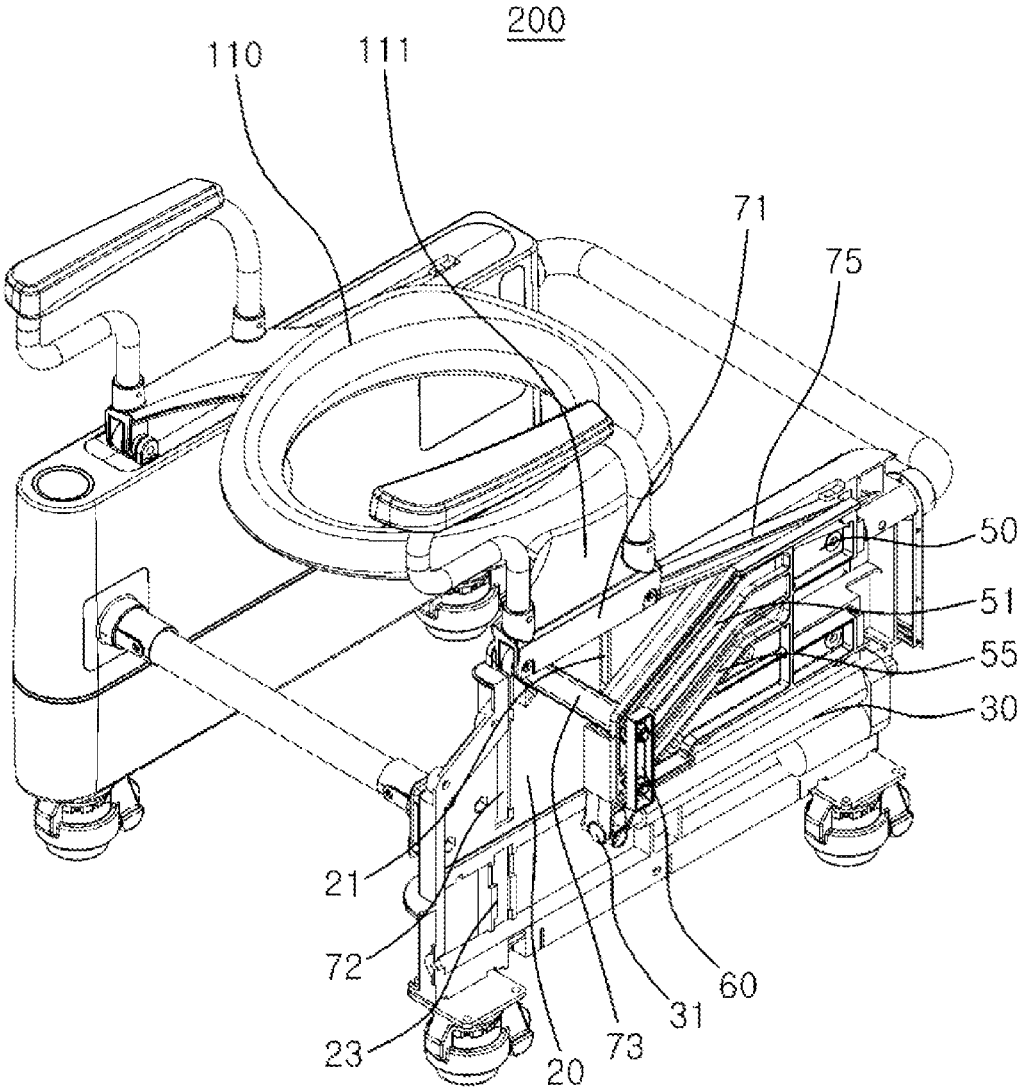
FIG. 7 is a perspective view of major elements.

FIG. 1 is a perspective view of an apparatus for aiding a toilet user in standing up according to an embodiment of the disclosure, FIG. 2 is a lateral view of the apparatus for aiding a toilet user in standing up in FIG. 1, FIG. 3 is a perspective view showing that a case is separated from an apparatus for aiding a toilet user in standing up according to an embodiment of the disclosure, and FIG. 4 is a separated lateral view of the apparatus for aiding a toilet user in standing up in FIG. 3. Further, FIG. 5 is a perspective view showing that one base frame is separated from an apparatus for aiding a toilet user in standing up according to an embodiment of the disclosure, FIG. 6 is a lateral view showing that one base frame is separated from the apparatus for aiding a toilet user in standing up in FIG. 5, and FIG. 7 is a perspective view of major elements in a state that one base frame is separated from the apparatus for aiding a toilet user in standing up shown in FIG. 5.

As shown in FIGS. 1 to 7, an apparatus 200 for aiding a toilet user in standing up according to an embodiment of the disclosure includes a movable seat 110 having a structure allowing a user of a toilet 150 to sit thereon, and a seat actuator 100 adjacent to the toilet 150 and controlling movement of the movable seat 110.

The movable seat 100 is movably mounted to the toilet 150. In other words, the movable seat 110 has a structure on which a user of the toilet 150 sits, and is movably mounted to the toilet 150. The movable seat 110 may be a general seat bundled with the toilet 150, or a special seat provided separately from the general seat bundled with the toilet 150.

The movable seat 110 has a structure that a user of the toilet 150 can sit on. Further, the movable seat 100 may be configured for direct contact with hips of a toilet user, or may be configured to indirectly contact and support the hips of the user with an additional medium (or a separate seat, etc.) interposed between the movable seat 110 and the hips.

The movable seat 110 is not immovably but movably mounted to the toilet 150, and therefore fastened to the seat actuator 100 as put on the rim of the toilet 150. In other words, the movable seat 110 is mounted onto the rim of the toilet 150 as fastened to the seat actuator 100, and thus kept movable corresponding to operations of the seat actuator 100.

The movement of the movable seat 110 is driven by the seat actuator 100. That is, the movable seat 110 has lifting movement and/or pivoting movement according to the operations of the seat actuator 100 so that a user of the toilet 150 can stand up, i.e. rise from the movable seat 110. The seat actuator 100 operates to make the movable seat 110 have either the lifting movement or the pivoting movement or have both the lifting movement and the pivoting movement.

Thus, the seat actuator 100 according to the disclosure is adjacent to the toilet 150 and controls the movement of the movable seat 100 so that the movable seat 110 can have at least one of the lifting movement and the pivoting movement.

The seat actuator 100 needs to have a structure to be conveniently and easily installed without spoiling an outer appearance since it is provided adjacent to the toilet 150 and makes the movable seat 110 move, i.e. have at least one movement between the lifting movement corresponding to vertical reciprocation and the pivoting movement corresponding to rotation.

Like this, the seat actuator 100 is required to have an easy and simple structure to be disposed adjacent to the toilet 150 and a structure for arrangement and miniaturization to occupy a minimum installation space. To this end, the seat actuator 100 may have various structures. The seat actuator 100 according to the disclosure employs a structure to be simply and easily installed at a side of the toilet 150 while occupying the minimum installation space. That is, the seat actuator 100 according to the disclosure is configured to operate the movable seat 110 through a simple structure without a gear assembly or the like complicated structure.

The seat actuator 100 according to the disclosure basically includes a base frame 20 adjacent to and stationarily mounted to the toilet 150, a driver 30 mounted to the base frame 20, a driving frame 50 driven to reciprocate by the driver 30, and a link assembly that has a first side connected to the driving frame 50 and a second side connected to a connection link 71 coupled to the movable seat 110 and produces lifting movement and pivoting movement of the movable seat 110 in accordance with the reciprocation of the driving frame 50.

With this configuration, the seat actuator 100 is covered with a case 10 to embellish an outer appearance and protect the foregoing elements. That is, the base frame 20, the driver 30, the driving frame 50 and the link assembly are provided inside the case 10.

Meanwhile, the seat actuators 100 according to the disclosure may form a pair to be respectively arranged at both lateral sides of the toilet 150. In other words, as shown in FIGS. 1 to 7, the seat actuators 100 according to the disclosure are respectively arranged at the opposite sides of the toilet 150 as one pair and operate synchronously with each other.

Like this, according to the disclosure, the seat actuators 100 for actuating the movable seat 110 are respectively arranged at both sides of the toilet 150 to form one pair, and therefore it is advantageously possible to make a smooth operation regardless of the weight of a user who uses the toilet 150 and prevent a failure due to excessive load.

As described above, the seat actuators 100 according to the disclosure may be respectively arranged at the opposite sides of the toilet 150. In this case, the seat actuators 100 have the same configurations and operations. Therefore, the configuration and operations of one seat actuator 100, i.e. one seat actuator 100 arranged at a first side of the toilet 150 between one pair of seat actuators 100 will be described representatively, and the same description will be applied to the configuration and operations of the other seat actuator 100. Of course, the seat actuator 100 may be arranged at only the first side of the toilet 150.

Below, the configuration and operations of the seat actuator 100, which is the core element of the disclosure, will be described in detail.

The base frame 20 is immovably mounted adjacent to the toilet 150. Specifically, the base frame 20 may be stationarily mounted being coupled to the toilet 150, or the base frames 20 respectively installed at the opposite sides of the toilet 150 may be stationarily mounted being connected to each other.

The base frame 20 may be formed as one pair of individual frames having the same shape are coupled facing with each other. Therefore, one pair of individual frames assembled into the base frame 20 forms an inner space. The inner space of the base frame 20 accommodates the driver 30, the driving frame 50 and the link assembly therein.

The base frame 20 is formed with a vertical guide hole 21 and a sliding guide hole 23, which will be described later. The vertical guide hole 21 guides a main guide pin 61 or a connection guider 60 (to be described later) to vertically move, and the sliding guide hole 23 guides a guide bar 72, which is employed for making the lifting movement of the movable seat 110 smooth (to be described later), to move in a vertical direction. In this regard, descriptions will be made later.

The driver 30 is stably mounted to the base frame 20. The driver 30 is stably mounted to the base frame 20 and generates and transmits a driving force so that the driving frame 50 can reciprocate. To this end, the driver 30 includes a driving shaft 31 that horizontally reciprocates based on the generated driving force.

The driving shaft 31 of the driver 30 is connected to the driving frame 50. Therefore, when the driver 30 operates, the driving shaft 31 may horizontally reciprocate and thus the driving frame 50 coupled to the driving shaft 31 may also horizontally reciprocate.

The driver 30 is stably fixed to a lower side in the inner space of the base frame 20 and drives the driving shaft 31 to horizontally reciprocate forward and backward. Further, the driving frame 50 is arranged in the inner space of the base frame 20 and horizontally reciprocates forward and backward above the driver 30 in accordance with the movement of the driving shaft 31 because the front lower side of the driving frame 50 is coupled to the driving shaft 31. The driving frame 50 is driven to reciprocate by the driver 30.

Specifically, the driving frame 50 is firmly and stably coupled to the driving shaft 31 of the driver 30 and driven by the driver 30 to horizontally reciprocate corresponding to the horizontal reciprocation of the driving shaft 31.

The driving frame 50 is placed on an installation portion (not shown) formed in the base frame 20 or an upper portion of the driver 30 to smoothly and stably reciprocate as firmly and stably coupled to the driving shaft 31. To make the driving frame 50 smoothly reciprocate horizontally, a roller 25 may be interposed between a lower portion of the driving frame 50 and the installation portion or an upper portion of the driver 30. Therefore, the driving frame 50 is driven by the driver 30 to smoothly and readily reciprocate horizontally with the roller 25 provided on the installation portion or the upper portion of the driver 30.

The driving frame 50 may be formed with a main operating route guide hole 51 for smoothly combining the lifting movement and the pivoting movement of the movable seat 110, and a sub operating route guide hole 55 for more stable operation. In this regard, descriptions will be made later.

The driving frame 50 connects with the first side of the link assembly. The link assembly has the first side connected to the driving frame 50 and the second side pivotally connected to the connection link 71 directly or indirectly coupled to the movable seat 110, thereby making the movable seat 110 have at least one of the lifting movement and the pivoting movement in accordance with the horizontal reciprocation of the driving frame 50.

That is, the first side of the link assembly is connected to the driving frame 50, and the second side is pivotably connected to the connection link 71 directly or indirectly coupled to the movable seat 110, thereby producing the lifting movement and the pivoting movement of the movable seat 110 as the driving frame 50 horizontally reciprocates.

The link assembly produces one of the lifting movement and the pivoting movement of the movable seat 110 while interlocking with the horizontal reciprocation of the driving frame 50, so that the movable seat 110 can operate to assist a user in stably standing up.

In the apparatus 200 for aiding a toilet user in standing up with this configuration and these operations according to the disclosure, the movable seat 110 where the toilet user sits has a simple structure to be automatically movable having at least one of lifting movement and pivoting movement, thereby having effects on simplifying the structure and assisting the toilet user in easily and safely standing up.

More detailed configuration and operations of the foregoing apparatus 200 for aiding a toilet user in standing up according to the disclosure are as follows.

The apparatus 200 for aiding a toilet user in standing up according to the disclosure is configured to make the link assembly operate in accordance with the reciprocation of the driving frame 50, thereby actuating the movable seat 110.

To this end, the driving frame 50 is basically formed with the main operating route guide hole 51, and the link assembly includes a vertical movement link 73 and a pivoting movement link 75 for connection between the driving frame 50 and the connection link 71 directly or indirectly connected to the movable seat 110. Specifically, the link assembly includes the vertical movement link 73 that has a first side connected to be guided and moved along the main operating route guide hole 51 and a second side pivotably connected to the connection link 71 and produces the lifting movement of the movable seat 110 in accordance with the reciprocation of the driving frame 50, and the pivoting movement link 75 that has a first side pivotably connected to the driving frame 50 and a second side pivotably connected to the connection link 71 and produces the pivoting movement of the movable seat 110 in accordance with the reciprocation of the driving frame 50.

The main operating route guide hole 51 formed as cut open in the driving frame 50 includes a main oblique guide hole 52 formed obliquely ascending from a front side (i.e. the front of the toilet) toward a rear side (i.e. the back of the toilet), and a main horizontal guide hole 53 horizontally extended from the main oblique guide hole 52.

Meanwhile, although it will be described later, the driving frame 50 may additionally include the sub operating route guide hole 55 having the same shape as the main operating route guide hole 51 and spaced apart from the main operating route guide hole 51 equidistantly at every point.

The sub operating route guide hole 55 formed as cut open in the driving frame 50 also includes a sub oblique guide hole 56 formed obliquely ascending from a front side (i.e. the front of the toilet) toward a rear side (i.e. the back of the toilet), and a sub horizontal guide hole 57 horizontally extended from the sub oblique guide hole 56.

Meanwhile, the link assembly includes the vertical movement link 73 and the pivoting movement link 75, each of which has the first side pivotably connected to the driving frame 50 and the second side pivotably connected to the connection link 71 as described above.

The connection link 71 pivotably connects with the second sides of the vertical movement link 73 and the pivoting movement link 75. Specifically, the second side of the vertical movement link 73 is pivotably connected to a first end, i.e. a front portion of the connection link 71, and the second side of the pivoting movement link 75 is pivotably connected to a second end, i.e. a rear portion of the connection link 71.

Further, the connection link 71 may be directly connected to the movable seat 110, or may be indirectly connected to the movable seat 110 through a connection medium, i.e. a seat connector 111. According to the disclosure, the connection link 71 may be fastened and connected to the movable seat 110 through the seat connector 111 because the seat actuator 100 is arranged as spaced apart from the lateral side of the movable seat 110.

The first side of the vertical movement link 73 is connected be guided and moved along the main operating route guide hole 51. Specifically, the first side of the vertical movement link 73 is penetrated by the main guide pin 61, and the main guide pin 61 is inserted in the main operating route guide hole 51 while penetrating the first side of the vertical movement link 73. Of course, the main guide pin 61 is inserted in and fastened to the main operating route guide hole 51 so they are not separated.

Like this, the vertical movement link 73 has the first side arranged as inserted in the main operating route guide hole 51 by the main guide pin 61 and the second side pivotably coupled to the first end, i.e. the front portion of the connection link 71, thereby producing the lifting movement of the movable seat 110 in accordance with the horizontal reciprocation of the driving frame 50. In more detail, when the driving frame 50 horizontally moves frontward, the first side of the vertical movement link 73 moves in an oblique direction while sliding along the main operating route guide hole 51, in particular, the main oblique guide hole 52 by the main guide pin 61, and thus the second side of the vertical movement link 73 is urged upward. In result, the connection link 71 moves upward by the vertical movement link 73, and thus the movable seat 110 is raised upward.

Meanwhile, the pivoting movement link 75 has the first side pivotably connected to the driving frame 50 and the second side pivotably connected to the second end, i.e. the rear portion of the connection link 71, thereby producing the pivoting movement of the movable seat 110 in accordance with the horizontal reciprocation of the driving frame 50.

In more detail, when the driving frame 50 horizontally moves frontward, the pivoting movement link 75 is also urged frontward. In this operation, a force applied to the pivoting movement link 75 affects the second end, i.e. the rear portion of the connection link 71. Therefore, the second end, i.e. the rear portion of the connection link 71 is raised pivoting on the first end, i.e. the front portion. In result, the movable seat 110 operates pivoting on the first end, i.e. the front portion of the connection link 71 to which the second side of the vertical movement link 73 is pivotably connected.

As described above, according to the disclosure, both the vertical movement link 73 and the pivoting movement link 75 are configured to simultaneously produce the movement of the movable seat 110 in accordance with the reciprocation of the driving frame 50, thereby having advantages of not only assisting a user of the toilet 150 in comfortably standing up but also minimizing possibility of unexpected accidents while the user rises from the toilet 150.

Meanwhile, the apparatus 200 for aiding a toilet user in standing up according to the disclosure employs an additional structure for stable, strong and smooth operations. In this regard, descriptions will be made below.

As described above, the driving frame 50 includes the sub operating route guide hole 55 separately from the main operating route guide hole 51. In the sub operating route guide hole 55, a sub guide pin 65 is inserted. Further, the connection guider 60 connects the main guide pin 61 and the sub guide pin 65 in a vertical direction so that the main guide pin 61 and the sub guide pin 65 can operate interlocking with each other.

With this configuration, when the driving frame 50 reciprocates, the main guide pin 61 moves up in an oblique direction while being guided along the main operating route guide hole 51, in particular, the main oblique guide hole 52 and moves horizontally along the main horizontal guide hole 53, and the sub guide pin 65 coupling with the main guide pin 61 by the connection guider 60 in the vertical direction also moves up in the oblique direction while being guided along the sub operating route guide hole 55, in particular, the sub oblique guide hole 56 by interlocking with the main guide pin 61 and moves horizontally along the sub horizontal guide hole 57.

With these operations, the vertical movement link 73 operates more stably and smoothly to thereby make the connection link 71 have more stable and smoother lifting movement.

In the foregoing description, the main guide pin 61 and the sub guide pin 65 are moved being respectively guided along the main operating route guide hole 51 and the sub operating route guide hole 55. In more detail, the main guide pin 61 and the sub guide pin 65 do not move in a horizontal direction along the horizontal reciprocation of the driving frame 50, but reciprocate in a vertical direction being respectively guided by the main operating route guide hole 51 and the sub operating route guide hole 55.

That is, the main guide pin 61 and the sub guide pin 65 reciprocate in the vertical direction being respectively guided by the main operating route guide hole 51 and the sub operating route guide hole 55 in accordance with the horizontal reciprocation of the driving frame 50, and therefore the vertical movement link 73 operates to produce the lifting movement of the connection link 71.

To produce more stable and smoother lifting movement of the vertical movement link 73, an additional configuration is provided according to the disclosure.

Specifically, as described above, the base frame 20 includes the vertical guide hole 21 formed corresponding to the vertical moving directions of the main guide pin 61 and the sub guide pin 65. The vertical guide hole 21 does not directly receive the main guide pin 61 and the sub guide pin 65, but receives the connection guider 60 for connecting the main guide pin 61 and the sub guide pin 65 to slide therein in the vertical direction.

Like this, the base frame 20 is formed with the vertical guide hole 21 in a direction corresponding to the vertical moving direction of the connection guider 60, and the connection guider 60 is inserted in and mounted to the vertical guide hole 21 and slidable in the vertical direction. Further, a bearing may be provided in a contact and sliding portion between the connection guider 60 and the vertical guide hole 21. With this additional configuration, the vertical movement of the connection guider 60 becomes smoother and more stable in accordance with the reciprocation of the driving frame 50, thereby producing the lifting movement of the vertical movement link 73, the connection link 71 connected to the vertical movement link 73, and the movable seat 110 more smoothly and stably.

Meanwhile, the first end, i.e. the front portion of the connection link 71 is pivotably connected to the vertical movement link 73, but this point (the first end) corresponds to a vertical reciprocating portion as the lifting movement of the vertical movement link 73 is produced. In other words, the first end, i.e. the front portion of the connection link 71 reciprocates in a vertical direction as the lifting movement of the vertical movement link 73 is produced.

According to the disclosure, an additional configuration is provided to make the first end, i.e. the front portion of the connection link 71 more stably and smoothly reciprocate in the vertical direction.

Specifically, the base frame 20 is formed with the sliding guide hole 23 corresponding to the vertical moving direction of the first end, i.e. the front portion of the connection link 71. Further, the guide bar 72 is long extended downward from the first end, i.e. the front portion of the connection link 71. With such an employed configuration, the guide bar 72 is arranged as inserted in the sliding guide hole 23, and slides up and down being guided by the sliding guide hole 23 when the lifting movement of the connection link 71 is produced. In result, the lifting operation of the connection link 71 becomes more stable and smoother.

In the foregoing disclosure, the vertical movement link 73 is configured to move being indirectly guided along not only the main operating route guide hole 51 but also the sub operating route guide hole 55, so that the vertical movement link 73 can firmly and stably operate in accordance with the reciprocation of the driving frame 50, thereby having advantageous effects on improving the stability of the whole operations and performing the whole operations more smoothly and stably with the additional configuration.

Figure 8:
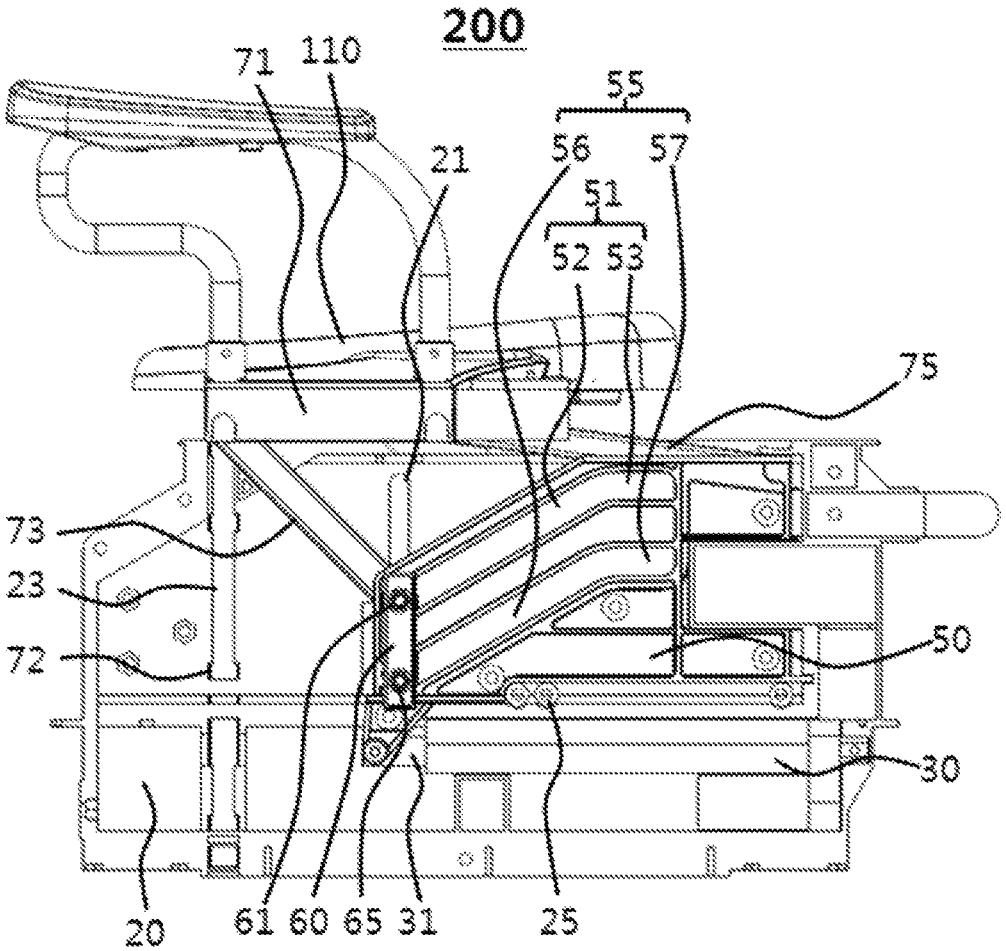
FIG. 8 is a lateral view showing a state before operating a movable seat to explain operations of an apparatus for aiding a toilet user in standing up according to an embodiment of the disclosure, and FIG. 9 a lateral view showing a state after operating the movable seat.
Figure 9:
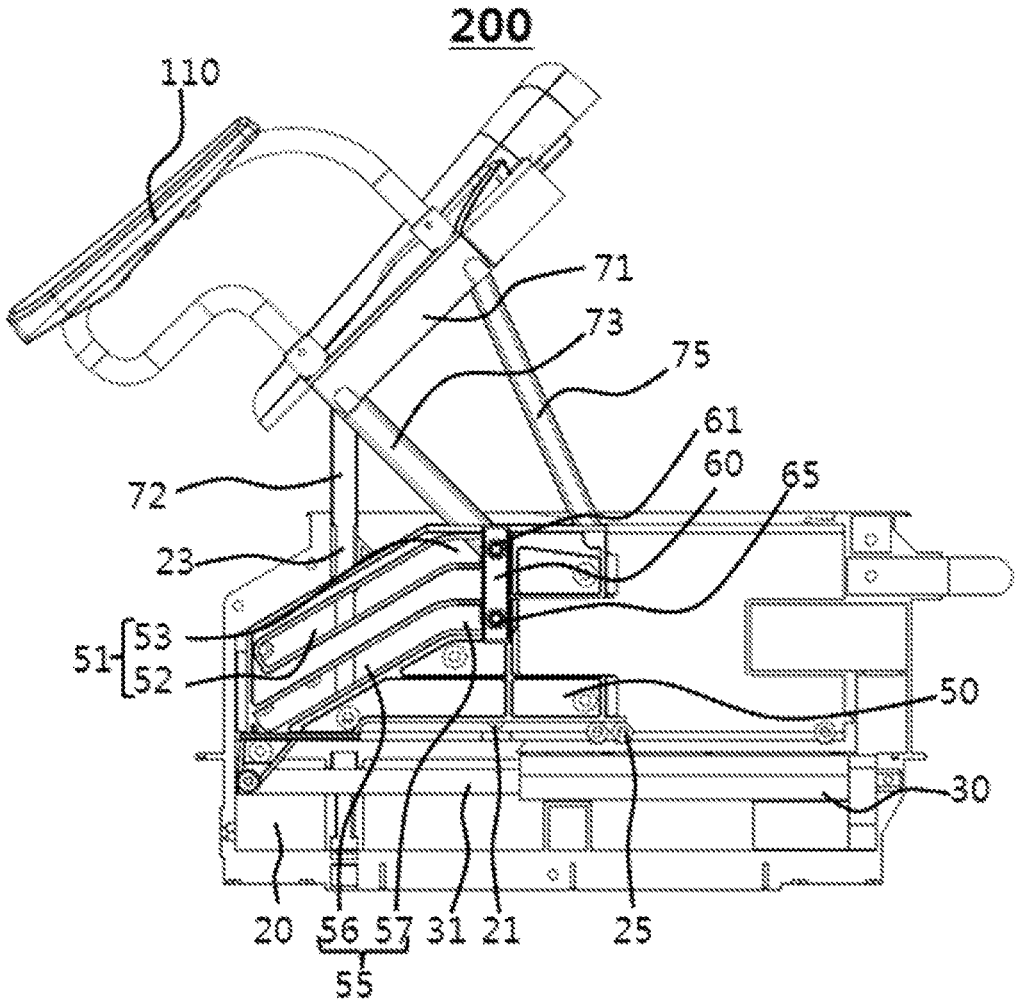

FIGS. 8 and 9 are lateral views for explaining operations of an apparatus for aiding a toilet user in standing up according to the disclosure. FIG. 8 is a lateral view of before the operation, and FIG. 9 is a lateral view of after the operation.

Before the operation as shown in FIG. 8, in the apparatus 200 for aiding a toilet user in standing up, the movable seat 110 is arranged at a position where a user can sit and keeps a horizontal state, and the driving frame 50 is positioned at a lower side.

In this state, when a user operates the driver 30, the driving frame 50 coupled to the driving shaft 31 of the driver 30 moves forward. During this operation, the connection guider 60 vertically moves in an upward direction along the vertical guide hole 21, and the main guide pin 61 and the sub guide pin 65 move upward being respectively guided by the main operating route guide hole 51 and the sub operating route guide hole 55 formed in the driving frame 50.

In this operation, the vertical movement link 73 urges the first end, i.e. the front portion of the connection link 71 to have the lifting movement, and the pivoting movement link 75 urges the second end, i.e. the rear portion of the connection link 71 to have the pivoting movement. In result, as shown in FIG. 9, the connection link 71 pivots forward while moving upward, and thus the movable seat 110 fastened and connected to the connection link 71 pivots moving upward.

The main guide pin 61 and the sub guide pin 65 move upward being respectively guided along the main oblique guide hole 52 and the sub oblique guide hole 56, and then are guided along the main horizontal guide hole 53 and the sub horizontal guide hole 57 in place without moving upward. While the main guide pin 61 and the sub guide pin 65 are respectively guided along the main horizontal guide hole 53 and the sub horizontal guide hole 57, the connection link 71 mainly has only the pivoting movement based on the pivoting movement link 75. Therefore, a user can more easily stand up with the pivoting movement at the last operation of the movable seat 100. To this end, each of the main operating route guide hole 51 and the sub operating route guide hole 55 is formed having the oblique guide hole and the horizontal guide hole.

In the apparatus for aiding a toilet user in standing up according to the disclosure with the foregoing objects and solutions, a movable seat on which the toilet user sits is automatically movable through a simple structure, and is configured to have at least one of lifting movement and pivoting movement, thereby having effects on simplifying the structure and having an effect on assisting the toilet user in easily and safely standing up.

Further, according to the disclosure, both the vertical movement link and the pivoting movement link are configured to produce the movement of the movable seat in accordance with the reciprocation of the driving frame, thereby having advantages of not only assisting a user of the toilet user in comfortably standing up but also minimizing possibility of unexpected accidents while the user rises from the toilet.

Although a few exemplary embodiments of the disclosure have been shown and described, these are for illustrative purpose only and it will be appreciated by those skilled in the art that changes may be made in these embodiments without departing from the principles and spirit of the invention, the scope of which is defined in the appended claims and their equivalents.

What is claimed is:

1. An apparatus for aiding a user of a toilet in standing up, comprising:

a movable seat movably mounted to the toilet; and a seat actuator arranged adjacent to the toilet and actuating the movable seat to move having at least one of lifting movement and pivoting movement, wherein the seat actuator comprises:

a base frame adjacent to and stationarily mounted to the toilet;

a driver mounted to the base frame;

a driving frame driven to reciprocate by the driver; and a link assembly comprising a first side connected to the driving frame and a second side connected to a connection link coupled to the movable seat and producing lifting movement and pivoting movement of the movable seat in accordance with reciprocation of the driving frame, wherein the link assembly comprises:

a vertical movement link comprising a first side connected to and moving along a main operating route guide hole and a second side pivotably connected to the connection link and produces the lifting movement of the movable seat in accordance with the reciprocation of the driving frame; and a pivoting movement link comprising a first side pivotably connected to the driving frame and a second side pivotably connected to the connection link and produces the pivoting movement of the movable seat in accordance with the reciprocation of the driving frame, wherein the driving frame comprises:

the main operating route guide hole; and a sub operating route guide hole having the same shape as the main operating route guide hole and spaced apart from the main operating route guide hole equidistantly at every point, wherein the base frame comprises a vertical guide hole, wherein the first side of the vertical movement link is penetrated by a main guide pin, the main guide pin is inserted in the main operating route guide hole while penetrating the first side of the vertical movement link, and a sub guide pin is inserted in the sub operating route guide hole, and wherein a connection guider is inserted in the vertical guide hole to be slidable in a vertical direction and connects the main guide pin and the sub guide pin in a vertical direction.

2. The apparatus according to claim 1, wherein the seat actuators are respectively arranged at opposite sides of the toilet and form a pair.

* * * * *